US007341545B2

(12) United States Patent
Cao

(10) Patent No.: US 7,341,545 B2
(45) Date of Patent: Mar. 11, 2008

(54) TORQUE RELEASING MECHANISM FOR FITNESS TRAINING EQUIPMENT

(76) Inventor: Guofang Cao, 22801 Chardonnay Dr., #1, Diamond Bar, CA (US) 91765

( * ) Notice: Subject to any disclaimer, the term of this patent is extended or adjusted under 35 U.S.C. 154(b) by 739 days.

(21) Appl. No.: 10/709,803

(22) Filed: May 28, 2004

(65) Prior Publication Data

US 2005/0266968 A1 Dec. 1, 2005

(51) Int. Cl.
*A63B 21/06* (2006.01)

(52) U.S. Cl. ..... 482/93; 482/87; 403/150; 416/133

(58) Field of Classification Search ..... 482/69, 482/86–89, 93–109; 403/150, 151, 157
See application file for complete search history.

(56) References Cited

U.S. PATENT DOCUMENTS 576,574 A * 2/1897 Guinn ..... 59/95
1,113,256 A * 10/1914 Smith ..... 59/95
2,651,533 A * 9/1953 Miller ..... 403/164
3,031,707 A * 5/1962 Wiley et al. ..... 15/147.2
5,393,162 A * 2/1995 Nissen ..... 403/154
6,527,418 B1 * 3/2003 Scherba ..... 362/294
6,572,483 B1 * 6/2003 Hoffman ..... 472/118

* cited by examiner

*Primary Examiner*—Terrence R. Till
*Assistant Examiner*—Ryan Durcik
(74) *Attorney, Agent, or Firm*—Jen-Feng Lee, Esq.

(57) ABSTRACT

Steel cables on fitness equipment, through repeated use, will build up undesired torque, due to irregular and unpredictable turns and spins. Such accumulated and undesired torque has a tendency to cause the cable to derail from the grooves on the gears it is supposed to stay and slide. The grab bar or handle bar, where a user grabs to start workout routine, likewise, has a tendency to turn or spin in an uncontrollable way and could potentially injure a user. Present invention effectively releases the undesired torque and restores the cable to its neutral and relaxed state, so that the fitness equipment will experience less malfunctioning, and user safety is enhanced.

2 Claims, 6 Drawing Sheets

TORQUE RELEASING MECHANISM FOR FITNESS TRAINING EQUIPMENT

BACKGROUND OF INVENTION

The present invention relates generally to design and construction of a torque releasing mechanism to be used on fitness training equipment or machines which employ cables to produce the needed resistance for weight training.

Most fitness equipment employs a cable and gear system to provide fitness users a way to train their body and build up strength. The simplest fitness equipment or any home gym system is made up of some form of resistance (typically weight packs) at one end, and a grab bar or handle bar at the other end so that a person can pull down the grab bar to exercise.

In the above-described cable/gear system, there is some amount of undesired torque being accumulated to the cable as the equipment is being used repeatedly. The cable, mostly made of steel or other metallic material, travels through the gears in the fitness equipment to provide a user the resistance (usually in a form of suspended weight packs) needed for the training. As the torque builds up in the cable over time, the handle bar may spin and turn when a user is just about to grab it or just after letting it go, and poses potential danger to a user.

Moreover, the built-up torque in the cable sometimes causes the cable to derail out of its groove in the gears, and, if not restrained properly in its groove, may cause the fitness equipment to malfunction, such as sudden change to the tension of the cable (due to the derailment of the cable during use) and pose even greater danger to users.

SUMMARY OF INVENTION

Present invention provides a torque-releasing mechanism for the cable on fitness equipment so that the undesired torque built up due to repeated use can be reduced/released. By doing so, the safety of a fitness equipment can be greatly enhanced.

BRIEF DESCRIPTION OF DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION

Figure 1:
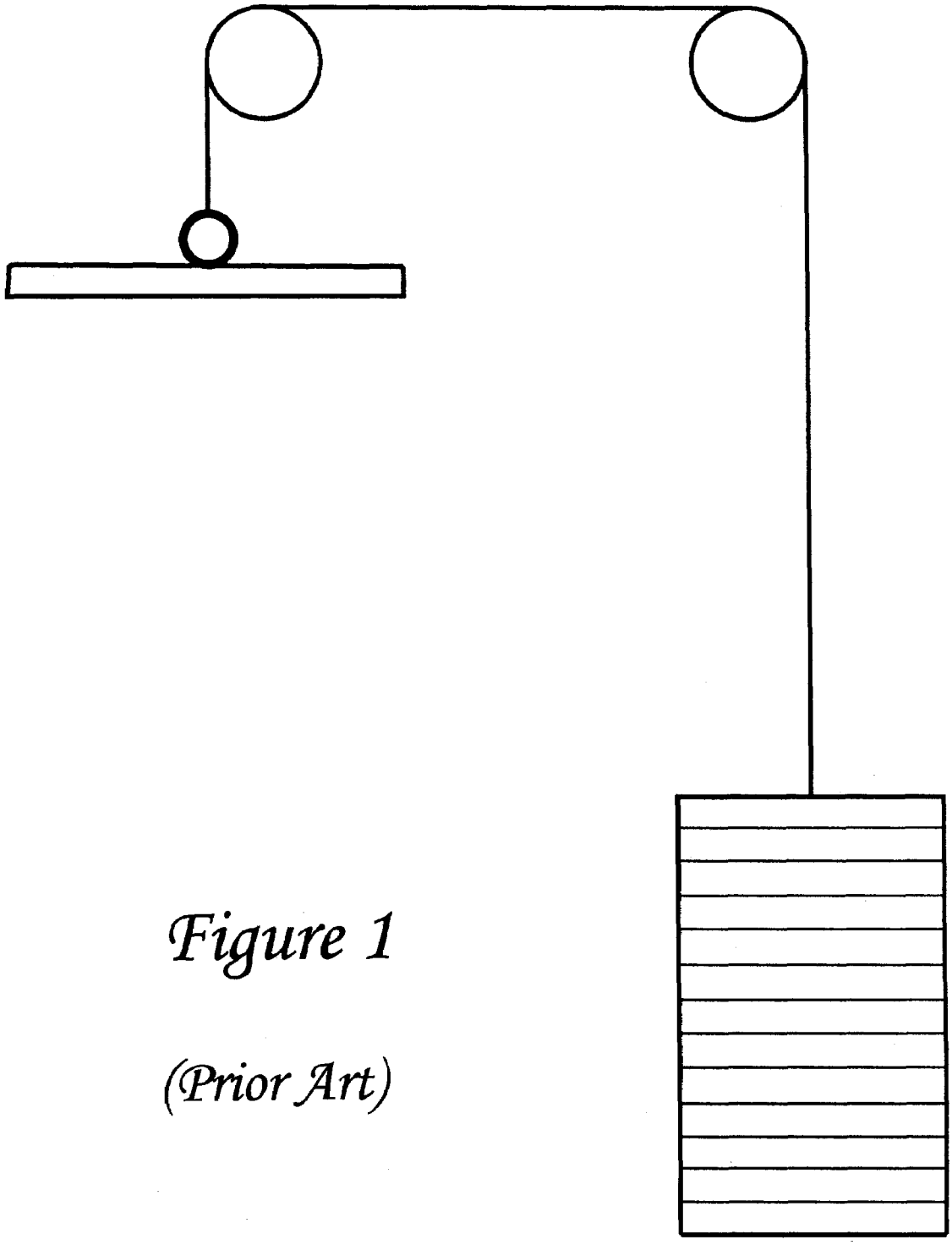
Figure 1 (Prior Art)
FIG. 1 shows a schematic of basic construction in typical fitness equipment.

In FIG. 1, a simple schematic of current fitness equipment or weight training machines are shown.

In FIG. 1, a user would hold the handle bar, which is connected directly to a cable strung through various gears to a resistance source (usually weight packs), and start his/her workout routine.

The handle bar can be anything that a user engages for training purpose, such as a knee/ankle bar, or any pieces to be used and engaged to certain body muscle group.

The resistance can also encompass bow-type (flexing resistance) or other spring-type mechanism.

Through repeated uses, the handle bar gets random and unpredictable turns and spins, some amount of undesired torque is built up and accumulated to the cable. Depending on the amount of torque accumulated, potentially, the cable has a tendency to spring out the groove on the gears on which it rests. This obviously causes the fitness system to malfunction and has a potential to injure unwitting users. Or, the amount of built-up torque would cause the handle bar to generate random turn or spin which would potentially hit a user if the spin/turn of the bar comes as a surprise to a user.

To release the undesired torque and reset the cable back to its neutral and relaxed state, so that the aforementioned drawbacks would not occur, present invention envisions an eye hook piece 10 for fastening to the cable. Said eye hook piece 10 is situated rotably relative to the handle bar, thus allowing the built-up torque to be released through the rotation mechanism of present invention.

Figure 2A:
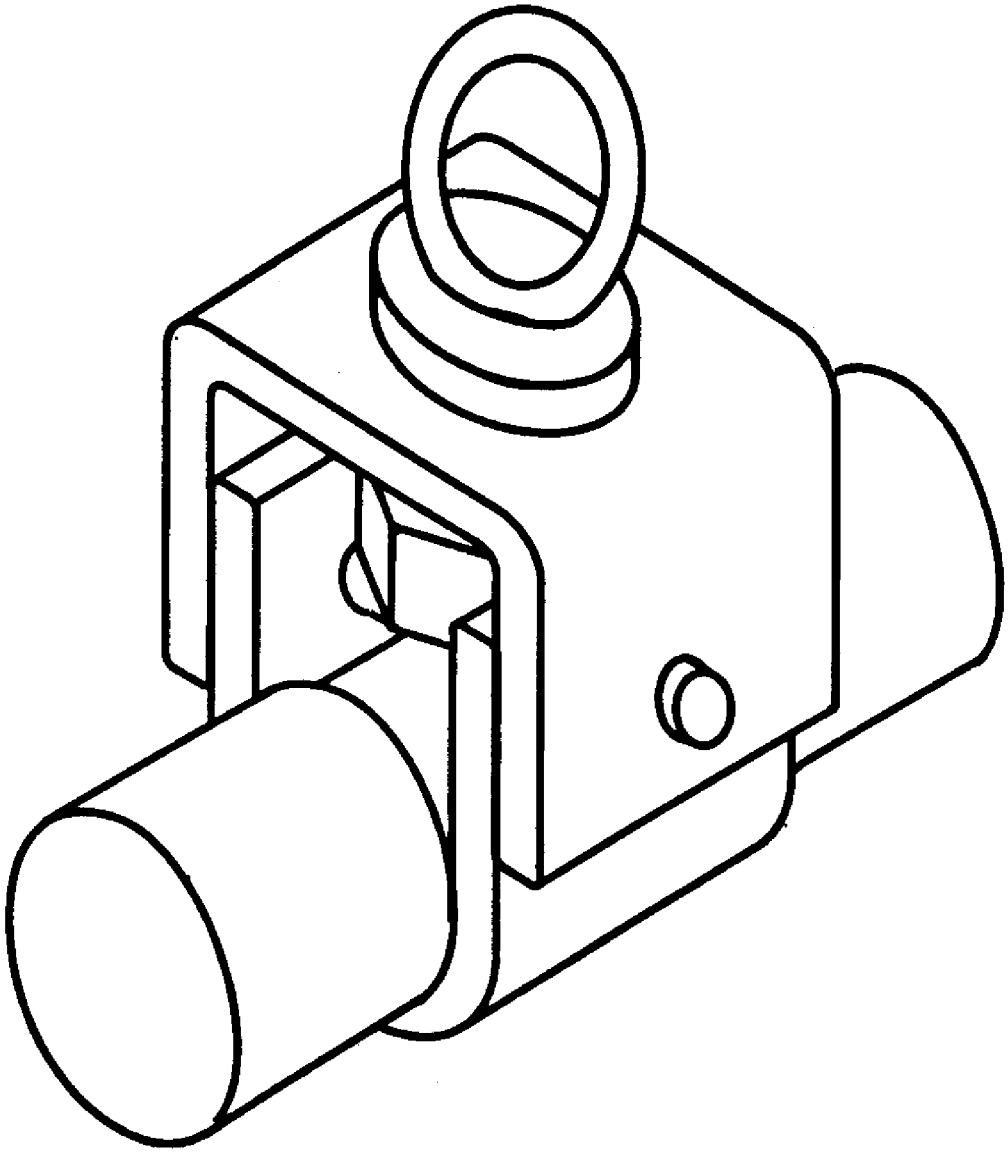
FIG. 2*a* shows a first embodiment of present invention in assembled view.
Figure 2B:
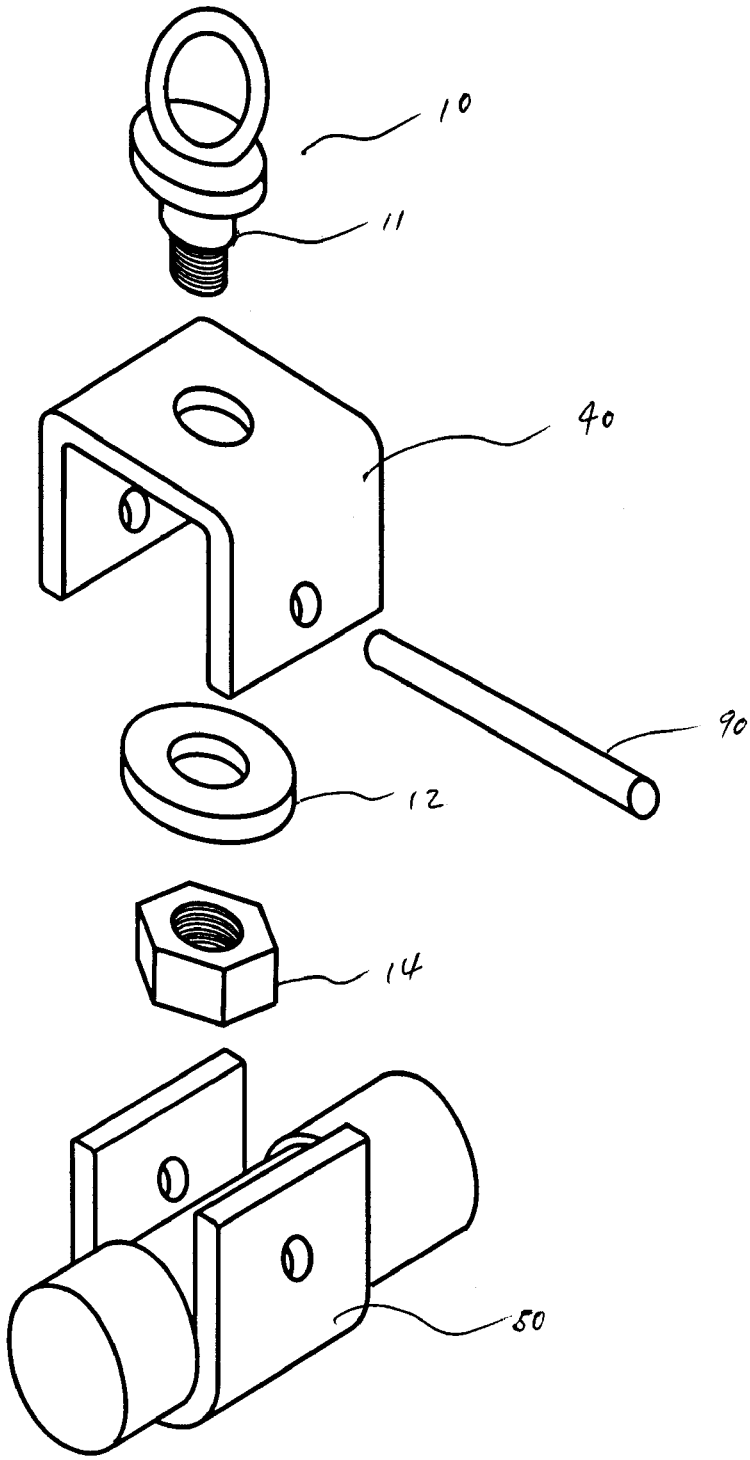
FIG. 2*b* shows the exploded view of first embodiment.

In FIGS. 2*a* and 2*b*, a bottom piece 50 is used to receive the handle bar on a typical fitness equipment. Eye hook piece 10 has a bolt body 11 with a threaded end that is inserted through an opening of a top cap piece 40.

A washer piece 12 and a nut 14 are used to secure top cap piece 40 to the eye hook piece 10, allowing said eye hook piece 10 to rotate freely relative to the top cap piece 40.

Figure 2C:
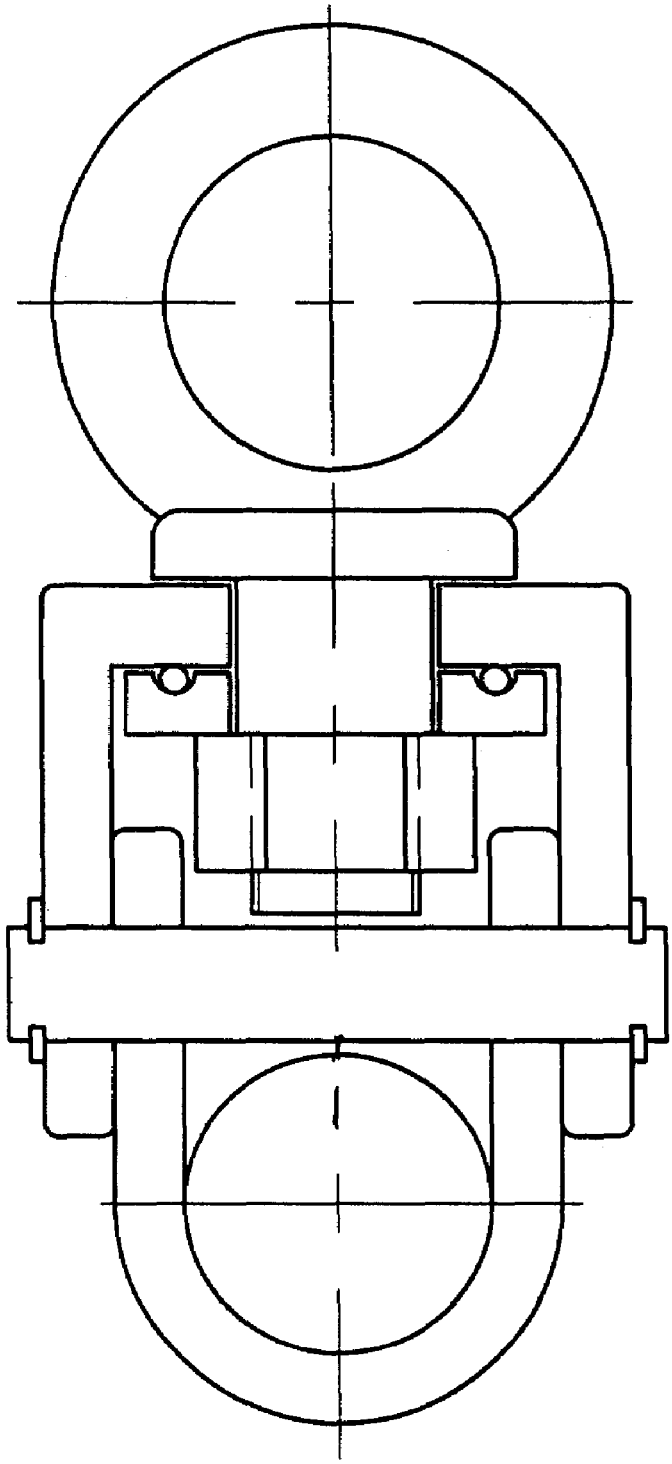
FIG. 2*c* shows the side structural view of first embodiment, with added ball bearing.

In FIG. 2*c*, ball bearings can be optionally added to the washer piece 12 to enhance the rotating freedom of the eye hook piece 10. Although FIG. 2*c* shows the ball bearings on top of the washer piece, present invention also envisions ball bearings sandwiched in between two round disks. Such washer pieces with ball bearings are readily available and need no further illustration.

In FIGS. 2*a*, 2*b* and 2*c*, the top cap piece 40 is secured to the bottom piece 50 by a locking pin 90.

Figure 3A:
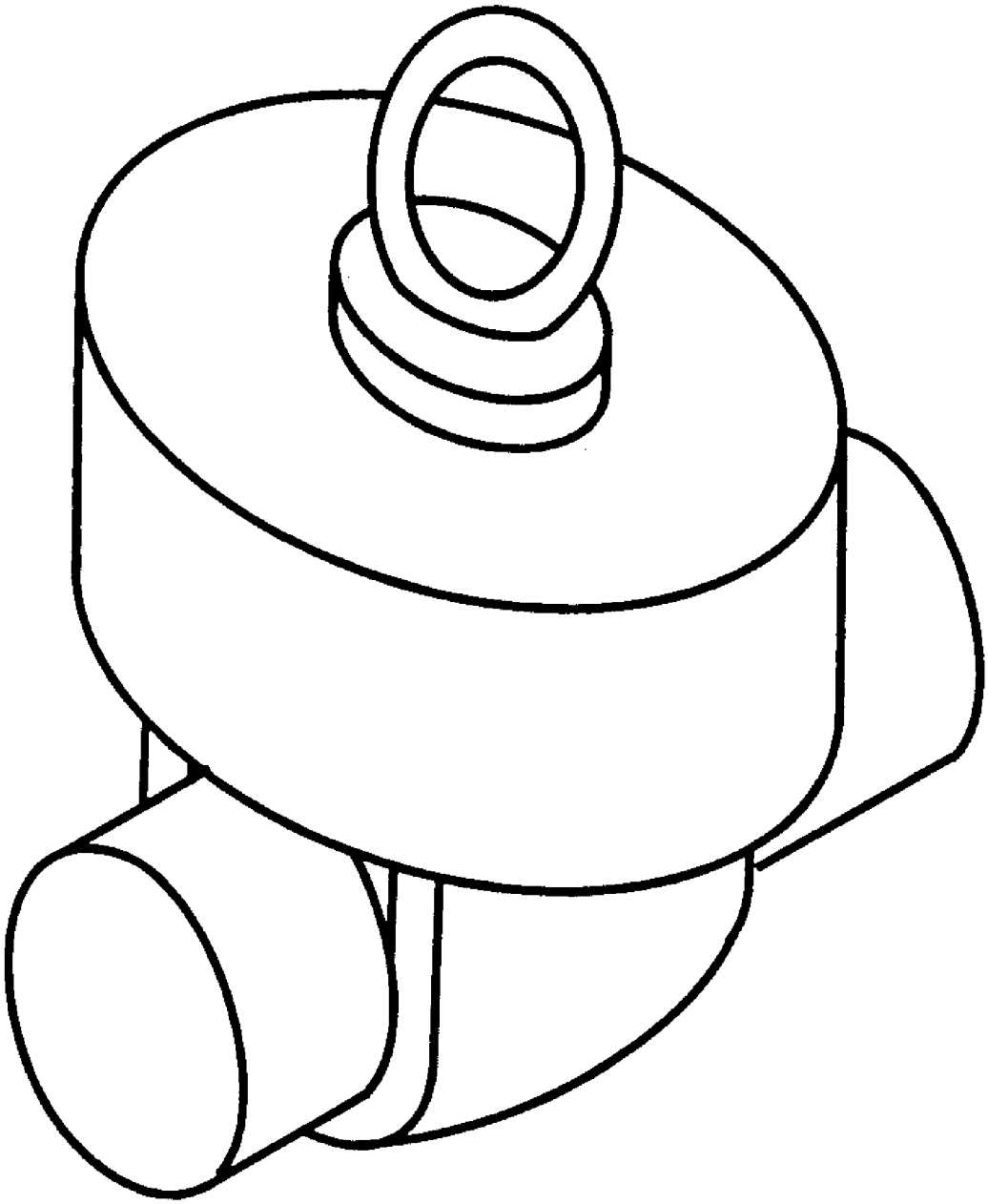
FIG. 3*a* shows a second embodiment of present invention in assembled view.
Figure 3B:
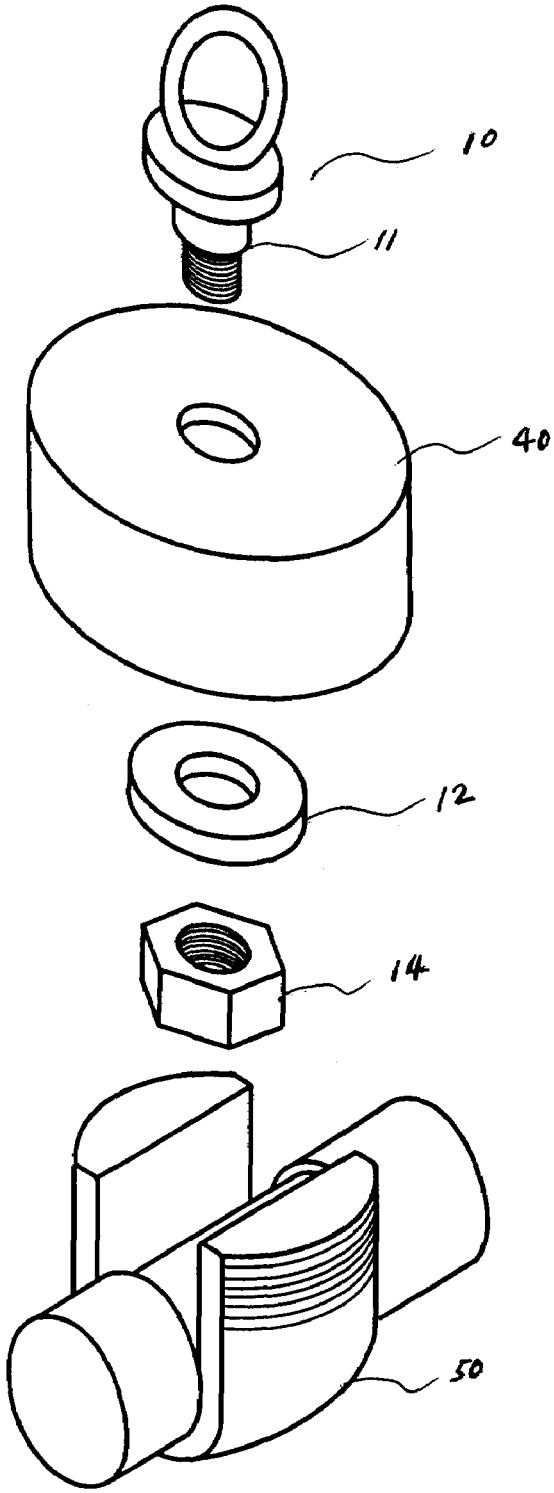
FIG. 3*b* shows the exploded view of second embodiment.

In FIGS. 3*a* and 3*b*, the outer circumferences of top cap piece 40 and bottom piece 50 are made into circular shape, so that one can have inside thread and the other can have outside thread for fastening the two together. Although FIGS. 3*a* and 3*b* show the top cap piece 40 fitted to the outside of bottom piece 50, the reverse can be done as well.

The invention claimed is:

1. Torque releasing mechanism for fitness equipment, comprising:

a. An eye hook piece having an eye for fastening cable and a bolt body with threaded end;

b. A top cap piece having a center aperture allowing said bolt body to be slidably inserted;

c. A washer piece for insertion into said bolt body;

d. A nut piece for securing said washer piece to the threaded end of said bolt body;

e. A bottom piece for receiving a grab bar of a fitness equipment; and, f. A locking pin of suitable rigid material for connecting said bottom piece to said top cap piece by inserting through overlapping holes on side panels of top cap piece and bottom piece, whereby said nut and washer are fastened to said eye hook piece and are situated in the space between the grab bar and said top cap piece.

2. Torque releasing mechanism for fitness equipment, comprising:

a. An eye hook piece having an eye for fastening cable and a bolt body with threaded end;

b. A top cap piece having a center aperture allowing said bolt body to be slidably inserted, said top cap piece has circular shape with thread lines along the inside wall;

c. A washer piece for insertion into said bolt body;

d. A nut piece for securing said washer piece to the threaded end of said bolt body;

e. A bottom piece for receiving a grab bar of a fitness equipment, said bottom piece has circular shape with thread lines along its outside wall and sized to be fit into and tightened with the inside wall of said top cap piece, whereby said nut and washer are fastened to said eye hook piece and are situated in the space between the grab bar and said top cap piece.

* * * * *